US007357392B1

(12) United States Patent
Wu

(10) Patent No.: US 7,357,392 B1
(45) Date of Patent: Apr. 15, 2008

(54) AIR HOCKEY TABLE THAT PRODUCES ATOMIZED GAS

(75) Inventor: Ming-Che Wu, Chia Yi Hsien (TW)

(73) Assignee: Hi-Star Co., Ltd., Chia Yi Hsien (TW)

( * ) Notice: Subject to any disclaimer, the term of this patent is extended or adjusted under 35 U.S.C. 154(b) by 0 days.

(21) Appl. No.: 11/714,548

(22) Filed: Mar. 6, 2007

(51) Int. Cl.
*A63F 7/07* (2006.01)

(52) U.S. Cl. ..... 273/126 A

(58) Field of Classification Search ..... 273/108, 273/108.1, 126 R, 126 A
See application file for complete search history.

(56) References Cited

U.S. PATENT DOCUMENTS 3,773,325 A * 11/1973 Crossman et al. ..... 273/126 A
3,992,009 A * 11/1976 Trbovich ..... 273/126 R
4,076,242 A * 2/1978 Joseph ..... 273/108.51
5,704,610 A * 1/1998 Goldfarb et al. ..... 273/108
6,003,866 A * 12/1999 Tsai ..... 273/126 A
2002/0066997 A1* 6/2002 Noolandi et al. ..... 273/126 A
2003/0168801 A1* 9/2003 Zucchi et al. ..... 273/126 R
2004/0164488 A1* 8/2004 Fitzgerald ..... 273/108.1
2005/0133993 A1* 6/2005 Keith ..... 273/108.1
2006/0202414 A1* 9/2006 Chen ..... 273/108.1

* cited by examiner

*Primary Examiner*—Raleigh W. Chiu
(74) *Attorney, Agent, or Firm*—Alan Kamrath; Kamrath & Associates PA

(57) ABSTRACT

A hockey table includes a table body, a top board mounted on a top of the table body and formed with a plurality of ventilating holes, and an atomizer mounted in the table body to spray an atomized gas which passes through the ventilating holes of the top board and protrudes outwardly from the top board. Thus, the atomized gas encompasses the top board to simulate a real and lively scene for the players to play the table hockey game, thereby enhancing the amusement effect of playing the hockey.

15 Claims, 3 Drawing Sheets

AIR HOCKEY TABLE THAT PRODUCES ATOMIZED GAS

BACKGROUND OF THE INVENTION

1. Field of the Invention

The present invention relates to a hockey table and, more particularly, to an air hockey table that is played indoors.

2. Description of the Related Art

A conventional hockey table comprises a table body, a plurality of support stands mounted on a bottom of the table body, a top board mounted on a top of the table body, a puck movable on the top board, and two sticks each movable on the top board to hit the puck. Thus, the sticks are held by two players to hit the puck so as to achieve an amusement of playing the hockey. However, the hockey table game is tedious, thereby decreasing the amusement effect during a period of time.

BRIEF SUMMARY OF THE INVENTION

In accordance with the present invention, there is provided a hockey table, comprising a table body, a top board mounted on a top of the table body and formed with a plurality of ventilating holes, and an atomizer mounted in the table body to spray an atomized gas which passes through the ventilating holes of the top board and protrudes outwardly from the top board.

The primary objective of the present invention is to provide an air hockey table that produces atomized gas.

Another objective of the present invention is to provide a hockey table, wherein the atomized gas encompasses the top board to simulate a real and lively scene for the players to play the table hockey game, thereby enhancing the amusement effect of playing the hockey.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
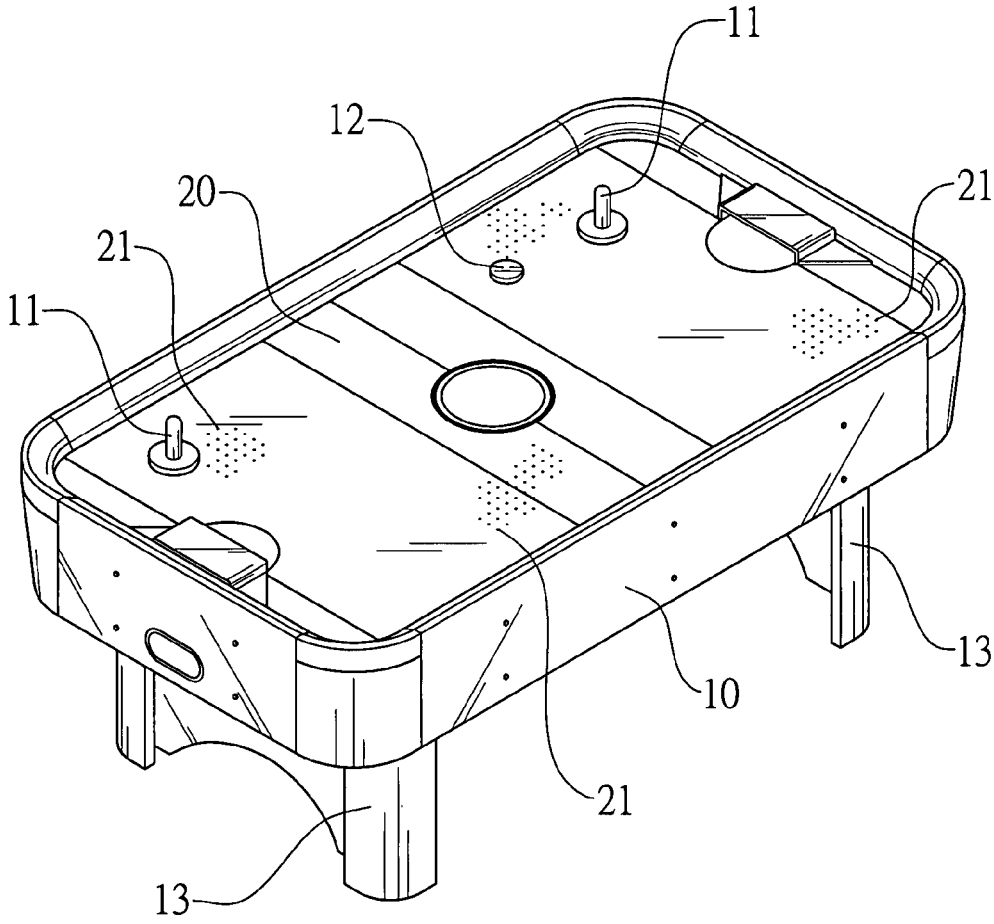
FIG. 1 is a perspective view of a hockey table in accordance with the preferred embodiment of the present invention.

Referring to the drawings and initially to FIG. 1, a hockey table in accordance with the preferred embodiment of the present invention comprises a table body 10, a plurality of support stands 13 mounted on a bottom of the table body 10, a top board 20 mounted on a top of the table body 10 and formed with a plurality of ventilating holes 21, a puck 12 movable on the top board 20, and two sticks 11 each movable on the top board 20 to hit the puck 12.

Referring to FIGS. 1-4, the hockey table further comprises an atomizer 40 mounted in the table body 10 to spray an atomized gas 42 which passes through the ventilating holes 21 of the top board 20 and protrudes outwardly from the top board 20, a blower 24 mounted in the table body 10 and located between the top board 20 and the atomizer 40 to blow the atomized gas 42 of the atomizer 40 toward the top board 20, and a container 30 mounted in the table body 10 to receive the atomizer 40.

The container 30 is located beside the blower 24 and has a side formed with an opening 31 facing the blower 24. The container 30 contains water 50 therein.

The atomizer 40 is provided with an atomizing vibration chip 41 to produce the atomized gas 42 from the water 50 in the container 30. The atomizing vibration chip 41 is mounted on and protruded outwardly from the atomizer 40. The atomized gas 42 of the atomizer 40 is received in the container 30 and passes through the opening 31 of the container 30 toward the blower 24.

The blower 24 includes a fan 25 located beside the opening 31 of the container 30 to carry an ambient air flow 26 toward the top board 20 and to accelerate the atomized gas 42 to move toward the top board 20.

The hockey table further comprises a separation plate 22 mounted in the table body 10 and located under the top board 20 to define a receiving chamber 23 between the top board 20 and the separation plate 22 to receive the atomized gas 42. The receiving chamber 23 is connected to the ventilating holes 21 of the top board 20. The separation plate 22 is located between the top board 20 and the blower 24 and is formed with a passage 220 to allow passage of the atomized gas 42. The passage 220 of the separation plate 22 is connected to the receiving chamber 23.

Figure 2:
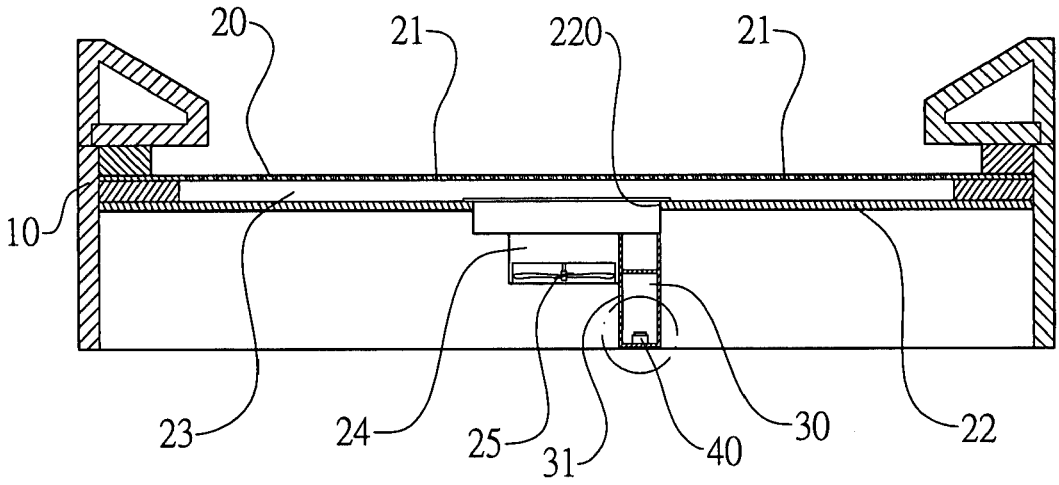
FIG. 2 is a front cross-sectional view of the hockey table as shown in FIG. 1.
Figure 3:
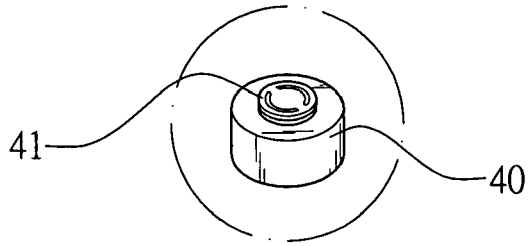
FIG. 3 is a locally enlarged perspective view of an atomizer of the hockey table as shown in FIG. 2.
Figure 4:
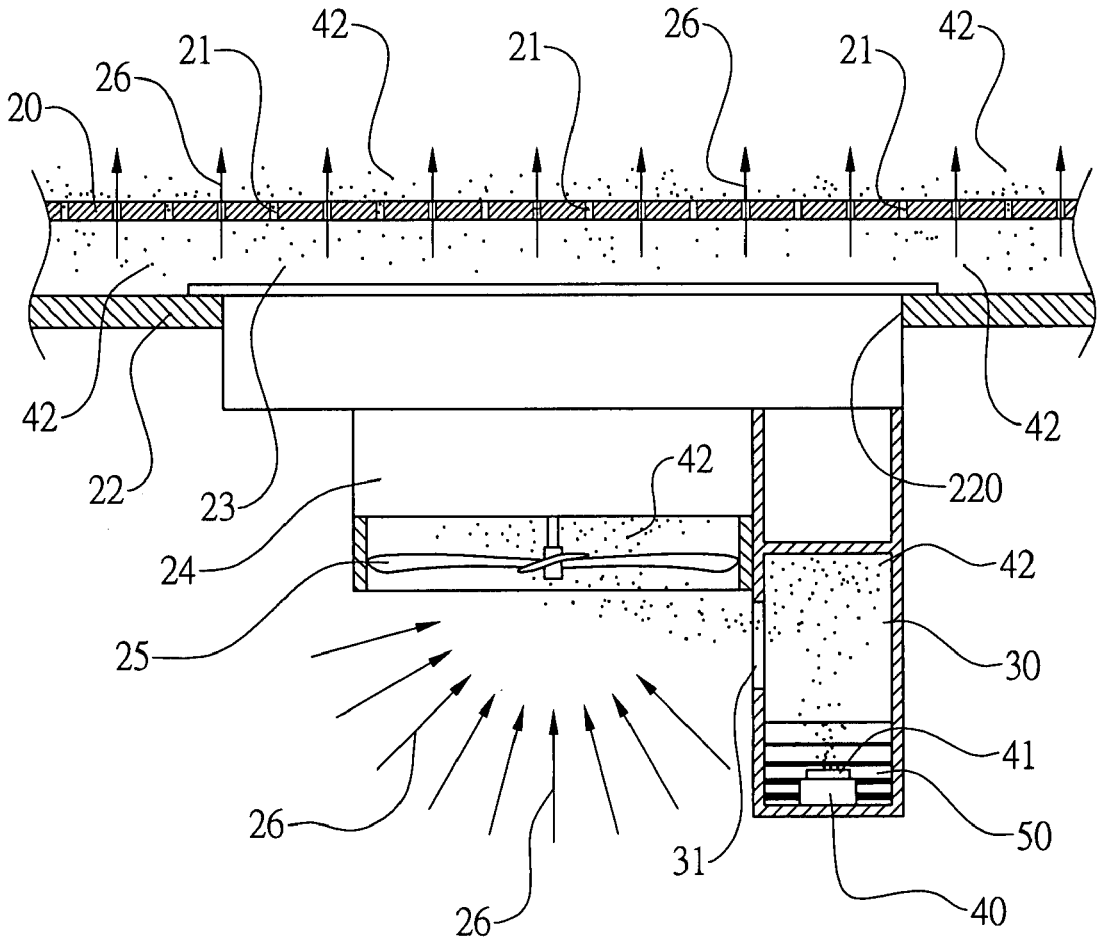
FIG. 4 is a locally enlarged operational view of the hockey table as shown in FIG. 2.

In operation, referring to FIG. 4 with reference to FIGS. 1-3, the fan 25 of the blower 24 blows the atomized gas 42 of the atomizer 40 from the container 30 into the receiving chamber 23 and carries the ambient air flow 26 into the receiving chamber 23 to mix with the atomized gas 42. Then, the atomized gas 42 contained in the receiving chamber 23 is blown outwardly from the ventilating holes 21 of the top board 20, so that the atomized gas 42 encompasses the top board 20 to simulate a real and lively scene for the players to play the table hockey game, thereby enhancing the amusement effect of playing the hockey.

Accordingly, the atomized gas 42 encompasses the top board 20 to simulate a real and lively scene for the players to play the table hockey game, thereby enhancing the amusement effect of playing the hockey.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A hockey table, comprising:

a table body;

a top board mounted on a top of the table body and formed with a plurality of ventilating holes;

an atomizer mounted in the table body to spray an atomized gas which passes through the ventilating holes of the top board and protrudes outwardly from the top board.

2. The hockey table in accordance with claim 1, further comprising:

a blower mounted in the table body and located between the top board and the atomizer to blow the atomized gas of the atomizer toward the top board;

a container mounted in the table body to receive the atomizer.

3. The hockey table in accordance with claim 2, wherein the container is located beside the blower.

4. The hockey table in accordance with claim 2, wherein the container has a side formed with an opening facing the blower.

5. The hockey table in accordance with claim 4, wherein the atomized gas of the atomizer is received in the container and passes through the opening of the container toward the blower.

6. The hockey table in accordance with claim 4, wherein the blower includes a fan located beside the opening of the container.

7. The hockey table in accordance with claim 2, wherein the container contains water therein, and the atomizer is provided with an atomizing vibration chip to produce the atomized gas from the water in the container.

8. The hockey table in accordance with claim 7, wherein the atomizing vibration chip is mounted on and protruded outwardly from the atomizer.

9. The hockey table in accordance with claim 2, further comprising a separation plate mounted in the table body and located under the top board to define a receiving chamber between the top board and the separation plate to receive the atomized gas.

10. The hockey table in accordance with claim 9, wherein the receiving chamber is connected to the ventilating holes of the top board.

11. The hockey table in accordance with claim 9, wherein the separation plate is located between the top board and the blower.

12. The hockey table in accordance with claim 9, wherein the separation plate is formed with a passage to allow passage of the atomized gas.

13. The hockey table in accordance with claim 12, wherein the passage of the separation plate is connected to the receiving chamber.

14. The hockey table in accordance with claim 9, wherein the blower blows the atomized gas of the atomizer from the container into the receiving chamber.

15. The hockey table in accordance with claim 14, wherein the atomized gas contained in the receiving chamber is blown outwardly from the ventilating holes of the top board to encompass the top board.

* * * * *